US005178533A

United States Patent [19]

Collenbusch

[11] Patent Number: 5,178,533

[45] Date of Patent: Jan. 12, 1993

[54] PROCESS FOR EXPLOITING A BURNER AND BURNERS FOR A ROTARY TUBULAR FURNANCE

[75] Inventor: Werner Collenbusch, Wiesbaden, Fed. Rep. of Germany

[73] Assignee: Enterprise Generale De Chauffage Industries Pillard, Marseilles, France

[21] Appl. No.: 808,048

[22] Filed: Dec. 12, 1991

Related U.S. Application Data

[63] Continuation of Ser. No. 581,801, Sep. 13, 1990, abandoned.

[30] Foreign Application Priority Data

Oct. 4, 1989 [DE] Fed. Rep. of Germany ..... 3933050

[51] Int. Cl.[5] ..... F23C 5/00

[52] U.S. Cl. ..... 431/8; 431/174; 431/182; 431/187; 431/284; 239/424

[58] Field of Search ..... 431/9, 10, 174, 182, 431/187, 188, 285, 284, 351, 183, 184; 239/404, 405, 406, 424

[56] References Cited

U.S. PATENT DOCUMENTS 2,335,188 11/1943 Kennedy .
4,157,889 6/1979 Bonnel ..... 431/182
4,333,405 6/1982 Michelfelder et al. ..... 431/184
4,347,052 8/1982 Reed et al. ..... 431/284
4,428,727 1/1984 Deussner et al. ..... 431/182
4,688,496 8/1987 Schreter ..... 431/184
4,718,359 1/1988 Skoog et al. ..... 431/184
4,930,430 6/1990 Allen et al. ..... 431/285
4,976,607 12/1990 Grimmard ..... 431/284

FOREIGN PATENT DOCUMENTS 2905746 8/1980 Fed. Rep. of Germany .

*Primary Examiner*—Carroll B. Dority
*Attorney, Agent, or Firm*—Dvorak and Traub

[57] ABSTRACT

This invention relates to a process for exploitation of a burner and to a burner for rotary tubular furnaces, wherein fuels and primary combustion air are supplied concentrically and the burner comprises a burner nozzle which comprises concentric supply conduits for the fuel and for the primary combustion air in the form of axial air and eddying air. In order to procure a process and burner which may operate with a smaller proportion of primary air and a greater range of adjustment, a dead zone is provided at the center of the flame directly all around a central fuel conduit and within an annular fuel supply conduit, in which a very small proportion of fuel is sent.

13 Claims, 5 Drawing Sheets

PROCESS FOR EXPLOITING A BURNER AND BURNERS FOR A ROTARY TUBULAR FURNANCE

This application is a continuation of application Ser. No. 07/581,801, filed Sept. 13, 1990, and now abandoned.

FIELD OF THE INVENTION

The present invention relates to a process for exploitation of a burner for a rotary tube furnace, in which fuels and primary air are supplied concentrically.

The present invention also relates to a burner for a rotary tube furnace equipped with a burner nozzle fitted with fuel and primary air conduits which are disposed substantially concentrically with respect to one another, which primary air includes air set in rotation and air flowing axially.

BACKGROUND OF THE INVENTION

A burner of this type is disclosed in German Patent DE 2 905 746.

This known burner comprises, in addition to a central fuel admission for the oil, another fuel admission disposed concentrically thereto for powdered coal or any other like fuel.

For the purpose of obtaining a good mixture, this solid fuel admission lies between two streams of primary air, of which one, which is the central stream, is set in rotation or eddy, i.e. it comprises a component in tangential or peripheral direction, and of which the other, outer, stream comprises an essentially axial flow velocity for the purpose of stabilizing the flame which penetrates far in the rotary furnace.

In other known burners, the stream of primary air is also provided to extend relatively far in the interior.

The known burner comprises, at its centre, a liquid fuel, generally oil, admission. The liquid fuel is atomized into fine droplets by means of a spray nozzle and is mixed, after leaving the central opening of the nozzle, with primary air which issues from the opening for outlet of eddying air, which opening is located radially around the central opening.

The known burners are usually employed with a proportion of primary air of between 8% and 25% of the total quantity of combustion air.

The power of the burner, i.e. the operational working, is regulated by a respective reduction or increase of the fuel and the air admission within a determined range of adjustment, in which the minimum adjustable working for obtaining a stable flame is equal to about 20 to 25% of the maximum working possible.

When the burner is started, oil must, as a general rule, be injected through the central orifice of the nozzle and must be ignited in order to pre-heat the furnace, since combustion of the solid fuel, which is supplied concentrically, is possible only in a sufficiently pre-heated furnace.

With respect to this state of the art, the present invention has for its object to provide a process for exploiting a burner of a rotary tube furnace and also a burner adapted to carry out this process, which may operate with a smaller proportion of primary air and present a broader range of adjustment of the operational working.

SUMMARY OF THE INVENTION

As far as the process is concerned, this object is attained by providing directly all around a central fuel supply conduit and/or radially inside an annular fuel supply conduit, a central dead zone in which, at the most, a reduced proportion of the primary combustion air is sent.

Thanks to the presence of a central dead zone, combustion thus begins at a greater distance in front of the centre of the nozzle of the burner compared with the heretofore known processes and burners In this way, seen in longitudinal section, starting from the centre of the front end of the nozzle, the resultant flame comprises a central zone which extends forwardly and radially, in which virtually no noteworthy combustion of the fuel is produced with the oxygen of the air.

It is true that such a central flame heart is also present in principle in the known burners, whilst, according to the present invention, this central dead zone is provoked deliberately and enlarged, more particularly by the fact that the least primary air possible is supplied in this zone.

However, even if it is not provided in the first place for combustion, a small proportion of primary air may be supplied in this central zone, this small proportion of primary air serving, however, in the first place to stabilize the flame and to prevent a rearward return of the combustion gases, the coal ash and the coke, which, without that, would lead to the soiling of the central part of the nozzle.

A small stream of primary air in this central zone, which is below 20% and preferably below 10% of the total primary air, avoids such a rearward return of the combustion products, without supplying much oxygen which would reduce the central zone rich in fuel.

It has been unexpectedly found that, thanks to the presence of such enlarged central dead zone, the range of adjustment of the burner may be considerably increased, up to less than 10% of the maximum working for which the burner is designed.

Insofar as such a burner must operate especially with solid and pulverized fuels, this means that, after a brief pre-heating with oil, it may already function with the solid fuel.

At the same time, it has been shown that, in such a process and in a burner designed for this process, the proportion of primary air which must be used for stabilizing the flame may be reduced by 2 to 10% and preferably below 6% with respect to the overall quantity of combustion air. This facilitates manufacture of the primary air supply devices which may be designed respectively weaker.

A particular advantage of the reduced consumption of primary air resides in the resulting saving of energy for an equal performance and also in the reduction of the proportion of nitrogen oxides in the combustion gases.

According to the invention, it is provided that, separately from the introduction of a small proportion of primary air in the central zone, at least two other separate streams of primary air are supplied, one of which is essentially axial and the other has a major part of the flow components in peripheral direction.

As far as the device mentioned above is concerned, the object of the invention is attained by locating the orifices for admission of the eddying air and of the axial air, outside the orifices for admission of the fuel, and the minimum radial distance with respect to the centre of the nozzle of the burner from the outlet orifices for the eddying air and the axial air, is at least equal to twice the radius of a central orifice of the flame stabilizer.

The flame stabilizer comprises a flange which surrounds a central opening, and which is located at the centre of the nozzle of the burner and, preferably at the end of a nozzle-holder for the oil. It contributes to forming and stabilizing the flame. The flame stabilizer which projects radially with respect to the central nozzle-holder for the oil, thus procures a sufficient radial distance from the other annular openings for the primary air and/or other fuels which are located radially outside the flame stabilizer.

The radii of the central opening of the flame stabilizer and of the annular orifice for the principal stream of primary air located more to the inside are chosen, with the result that the inner stream of primary air lies at a distance from the centre of the nozzle which corresponds to at least double the central opening of the flame stabilizer. In this way, the central opening of the flame stabilizer corresponds substantially to the orifice of the nozzle of the central fuel conduit.

In this way, the fuel issuing centrally does not come into contact too soon with the oxygen of the principal streams of primary air.

In addition, in the preferred embodiment of the invention, there is provided in addition an annular conduit for a solid and/or gaseous fuel, disposed radially inside the primary air conduit and radially outside the flame stabilizer.

The expression "primary air conduit" generally refers to the major part of the primary air which is supplied axially or in eddying form and must not cover the small proportion of primary air (central air) which is supplied in the central zone of the flame to avoid the rearward return of the combustion products.

For the supply of this latter small proportion of primary air, according to the invention, openings are provided in the flame stabilizer, outside the central opening.

The circulation of this small part of primary air takes place in an annular conduit included between the central support of the oil nozzle and the following inner wall in radial direction for another admission of fuel or for one of the principal streams of primary air.

In addition, it is advantageous if the outlet opening for the axial air stream lies as far to the outside as possible in the radial direction and if it presents, furthermore, an axially projecting outer edge.

This outer ring contributes to a better constancy of the axial direction of the air, with the result that combustion is improved and the flame is stabilized.

According to the invention, the annular conduits for supplying primary air and/or solid or gaseous fuel, have conical walls and these walls as well as the concentric tubes connected thereto are axially displaceable with respect to one another, so that the free transverse section of the annular passage can thus be adjusted.

However, the ends of each conduit are preferably cylindrical in order to avoid a divergent flow parallel tc the direction of the conical walls.

According to the invention, in the conical part of the annular conduit for the axial air, radial partitions are disposed, intended for the axial orientation and for the circulation of the primary air in separate channels, which are disposed on a ring and which extend essentially in axial direction.

These partitions contribute to an additional axial orientation of the corresponding primary air and also increase the axial outlet velocity, in that they reduce the free section of the annular conduit and they divide it into a plurality of individual channels disposed all around a ring. Moreover, in a preferred embodiment of the invention, some of these channels are closed at least partly or are adjustable. To that end, the partitions may for example be made sufficiently wide in peripheral direction to obturate a channel at least partly or they correspond to a closed channel.

It is thus possible to obtain that the sum of the free sections of the channels be less than the transverse section of the annular conduit for the primary air flowing in axial direction.

As has already been explained, the axial flow velocity of the air is thus increased, which further contributes to stabilizing the flame.

In addition, according to the invention, the flame stabilizer is provided to be offset rearwardly in axial direction with respect to the openings for outlet of the principal part of the primary air and the solid or gaseous fuels. This may be effected for example by fixing the flame stabilizer to the tube enveloping the pipe of the burner, which is axially displaceable, which tube is consequently offset axially.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
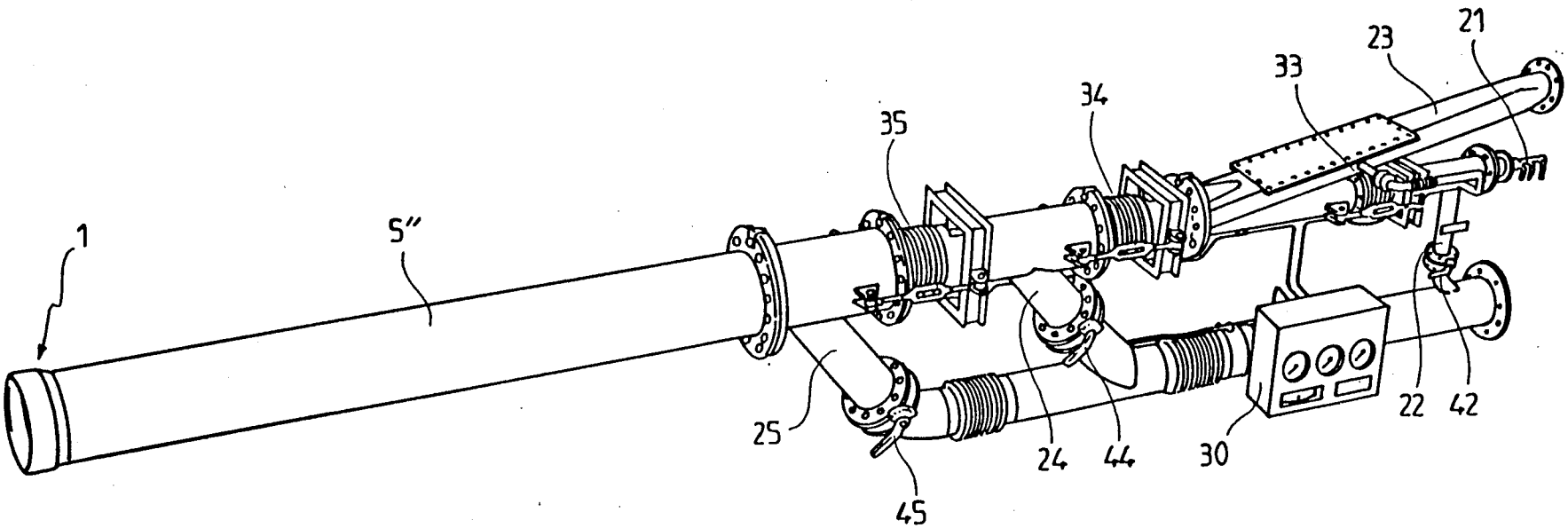
FIG. 1 is an overall view of a burner with part of the supply installations.

Referring now to the drawings, FIG. 1 shows a burner nozzle 1 placed at the end of an outer burner tube 5'', which is at the same time the outer wall of a conduit 5' for primary air which flows in axial direction.

At the other end of the outer tube 5'', different supply devices are fixed or connected by flanges.

The axial air arrives via a tube 25, the eddying air arrives via a tube 24, and these two primary air parts are adjustable separately by respective valves 45 and 44 and are connected to the same principal primary air conduit. At the rear end of the burner shown in FIG. 1, a conduit 22 branches from this principal primary air conduit and this branch terminates in a tube which concentrically surrounds the tube enveloping the burner pipe 10'.

In this way, a small part of the primary air coming from the branch 22 flows through an annular conduit 11' and issues through openings 13 (cf. FIG. 2*b*) in the central zone of the flame. A liquid fuel such as oil is supplied centrally to the nozzle of the burner via conduit 21.

Figure 3:
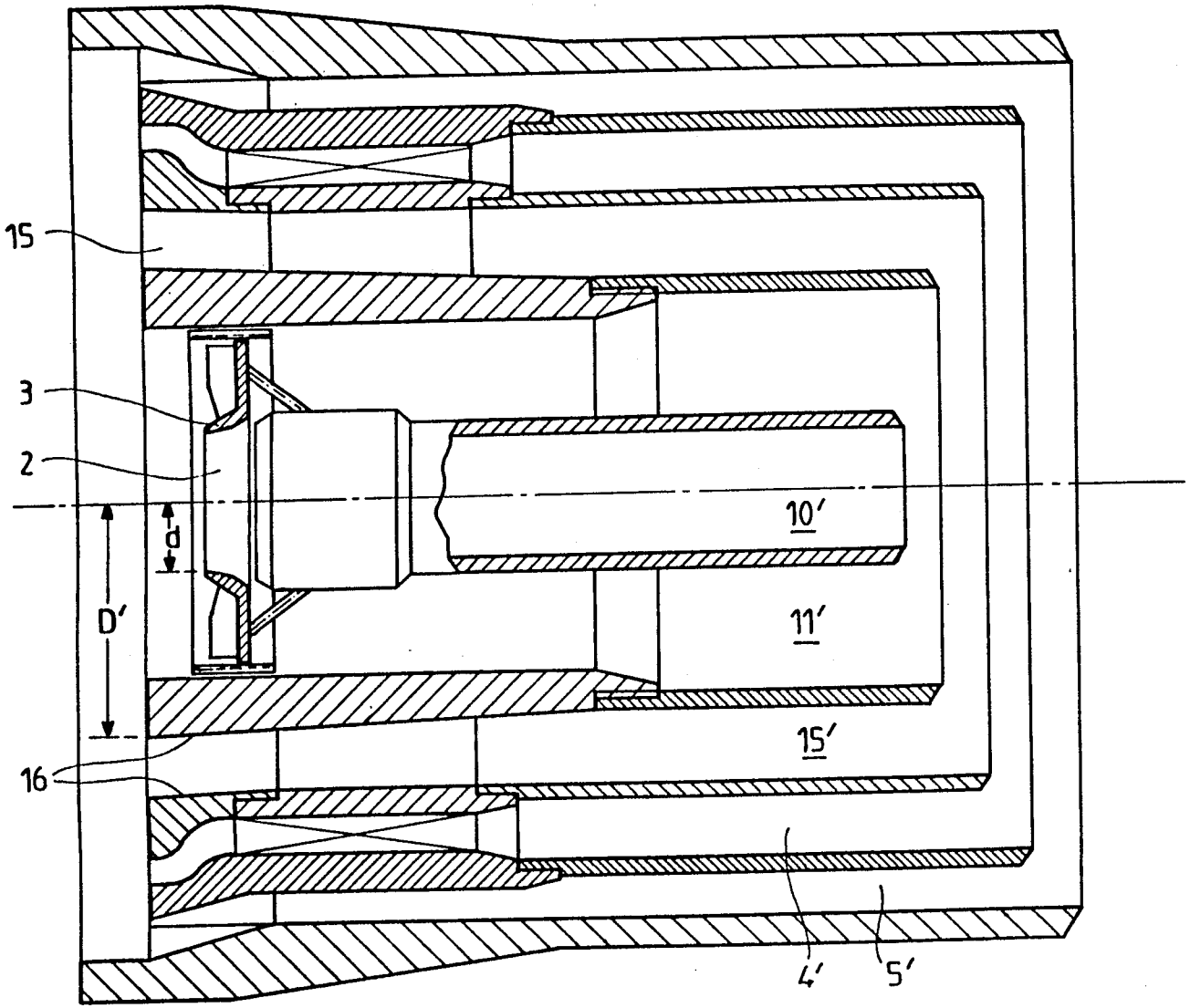
FIG. 3 is a longitudinal section through another embodiment of a burner nozzle with possibility of supplying pulverized solid fuels.
Figure 5:
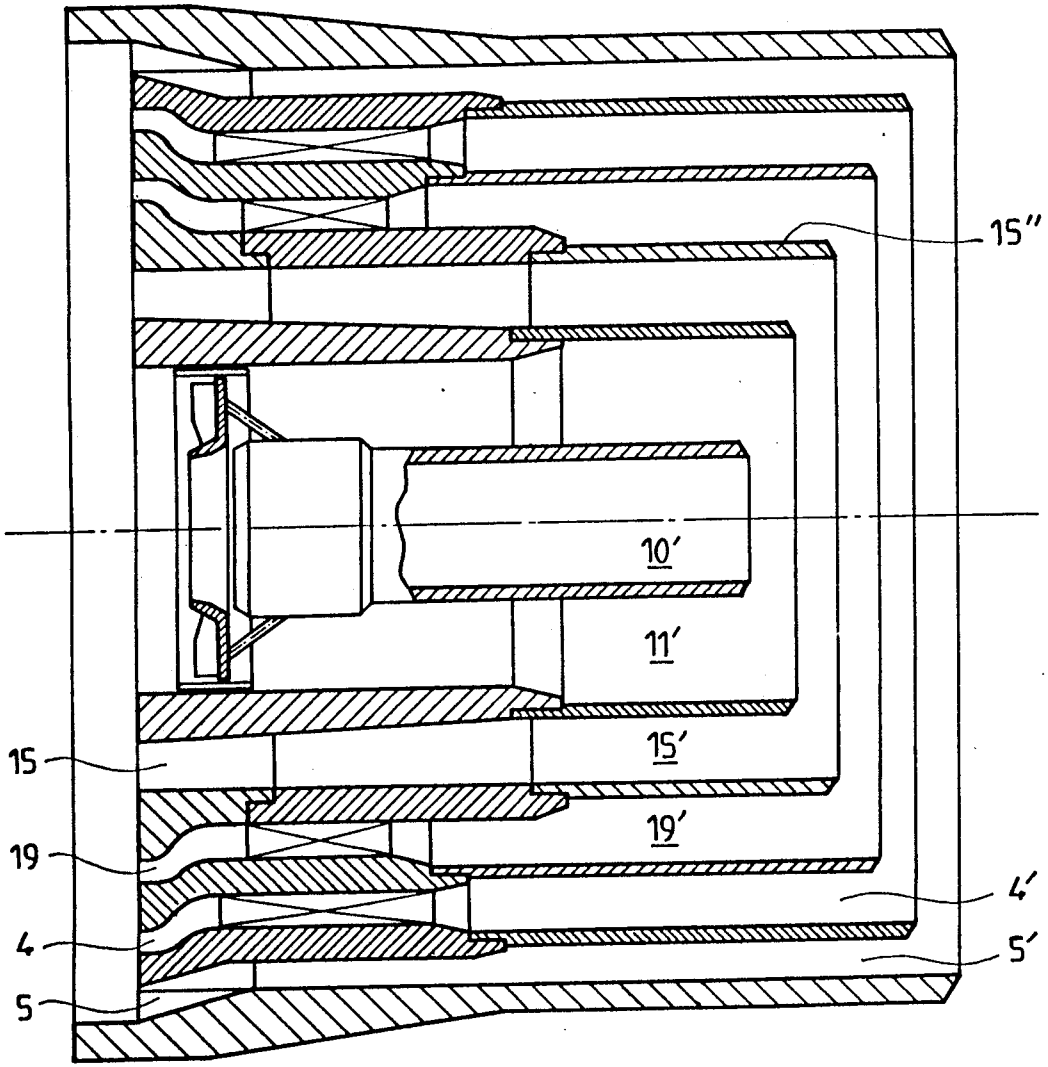
FIG. 5 is a longitudinal section through a burner nozzle with additional possibility of supplying a solid fuel and a gaseous fuel.

A tube 23, which is intended for supplying pulverized solid fuels, generally powdered coal, is connectted to the annular conduit 15' visible in FIGS. 3 and 5.

The concentric tubes 10'', 11'', 4'', 5'', 15'' and 19'', which are engaged in one another, have different lengths. The innermost tubes project axially towards the rear beyond the outermost tubes, with the result that, as shown in FIG. 1, adjusting devices 33, 34, 35 may be positioned which allow a relative axial displacement of the tubes with respect to one another. To that end, the individual tubes are connected to one another by means of deformable gussets.

A monitoring unit 30 serves to monitor and control the streams of primary air.

Figure 2B:
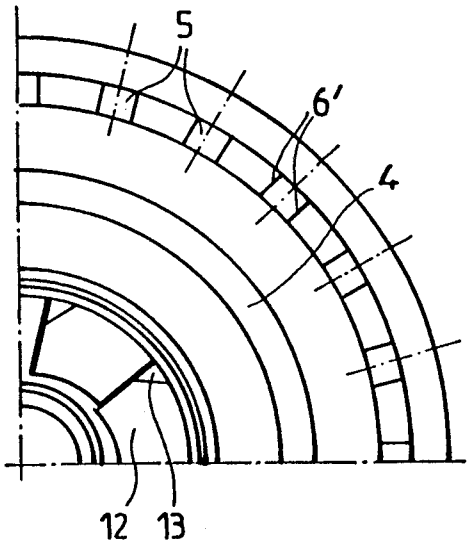
FIG. 2*b* is a partial left-hand view of FIG. 2*a*.
Figure 2A:
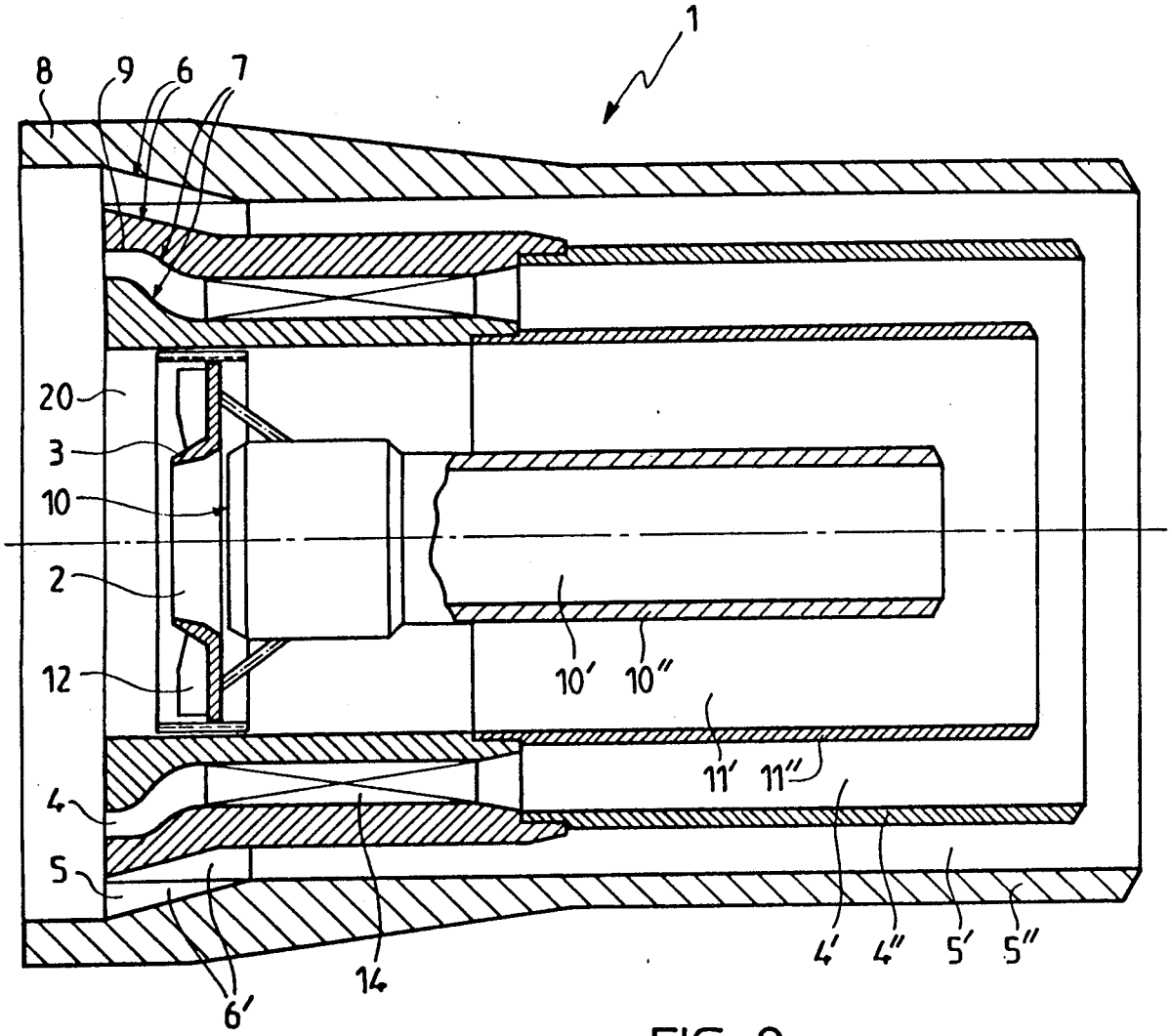
FIG. 2*a* is a longitudinal section through a first embodiment of a burner nozzle.

FIG. 2*a* shows a longitudinal section and FIG. 2*b* a partial front view of a burner nozzle which is designed to operate exclusively with a fuel, for example oil, arriving at the centre.

The flame stabilizer 3, which is located at the end of tube 10', which envelops the nozzle-holder pipe of the oil burner and which projects radially with respect to the opening of the nozzle, guarantees that the opening 4 of the annular supply conduit along 4' opens out at a considerable radial distance from the central opening 2 of the flame stabilizer.

Figure 4:
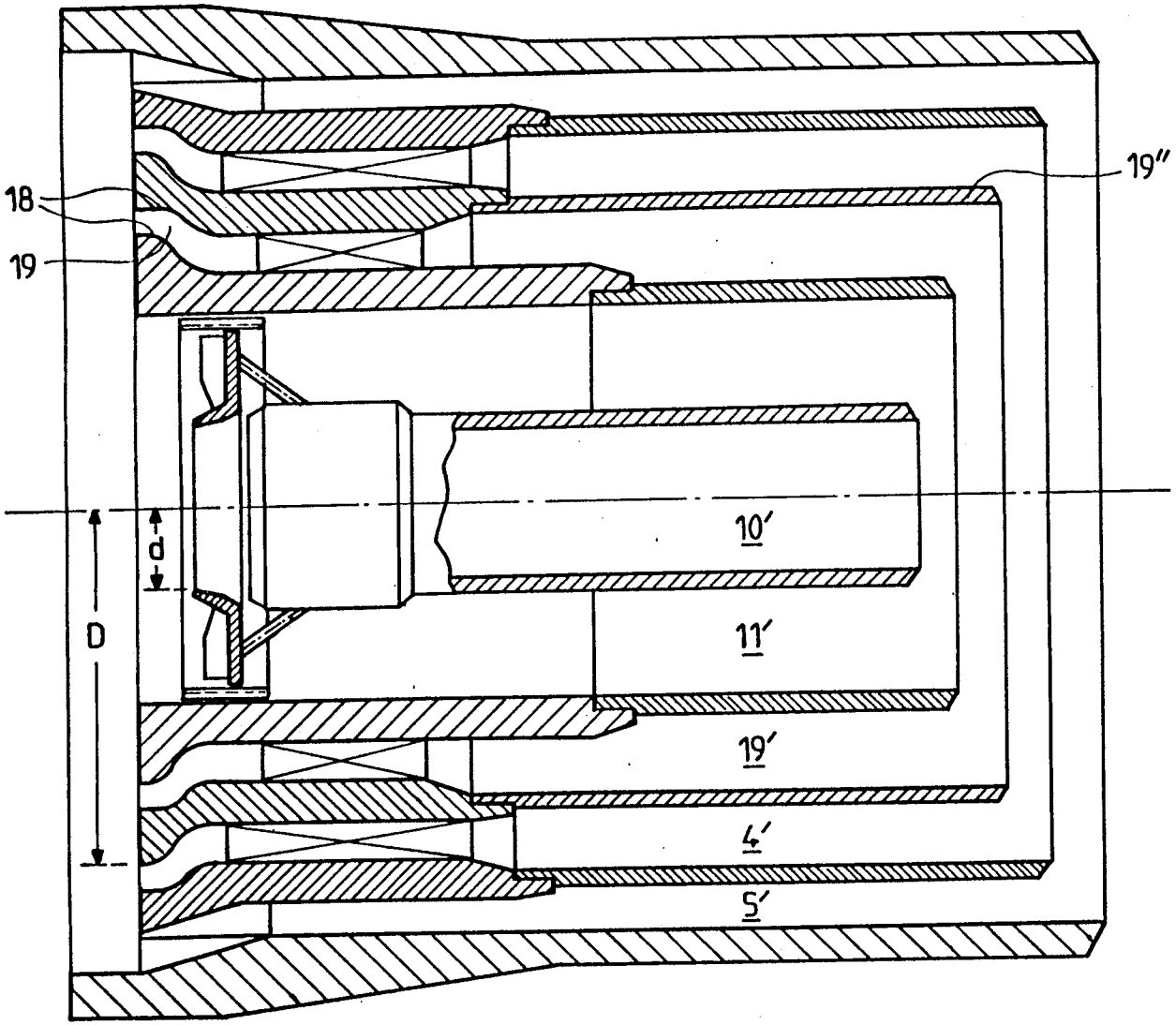
FIG. 4 is a longitudinal section through a burner nozzle with additional possibility of supplying a gaseous fuel.

In the embodiment shown, the radial distance D of the annular opening 4 with respect to the axis of the burner is more than triple the radius d of the opening 2. The corresponding distances are indicated in FIG. 4, in which the ratio D/d is even greater.

The zone located essentially in front of the flame stabilizer constitutes a central dead zone 20, which is located outside the central fuel stream and clearly within the principal admission of primary air issuing from the annular openings 4 and 5.

This dead zone may extend axially up to a multiple of the diameter of the flame stabilizer. A mixture of the primary combustion air and of the fuel sufficient for the formation of a flame is produced only outside this central dead zone. The flame stabilizer comprises a hub in the form of a flange surrounding a central orifice 2. This hub comprises small openings 13. The outer face of the hub, i.e. the front face, bears fins 12 which guide the small proportion of primary air issuing from openings 13.

The outer supply conduit 5' comprises at its end conical walls 6 which diverge outwardly. In the zone of these walls 6 are located juxtaposed partitions 6' which have a longitudinal section of triangular shape. These triangular walls are juxtaposed along a common side which is parallel to the axis of the burner and which is placed at the same radial distance from this axis as the outer wall of the conduit 5'.

In this way, it is possible to displace the tube 4'' axially with respect to tube 5'' without the function of partitions 6' being influenced thereby.

FIG. 2*b* shows a front view of the front edges of the partitions 6'.

However, partitions 6' may also have, in peripheral direction, a sufficient width for them to correspond to the parts located between the channels 5 shown in FIG. 2*b*. These parts may also be considered as closed channels 5.

The supply conduit 4' comprises in front of the conical end, a device 14 for eddying the air, i.e. for setting it in rotation about the axis of the burner. This device is essentially constituted by fins for guiding the air which are oriented obliquely with respect to the axis of the burner. Thanks to the axial displacement of tube 11'' with respect to tube 4'', the distance between the conical walls 7 of conduit 4' may be varied, with the result that the transverse section of conduit 4' may thus be modified. The terminal part of conduit 4' in the zone of opening 4 is, however, again cylindrical in order to avoid a divergent flow of the eddying air issuing from this opening.

Similarly, edge 8, which projects forwardly in axial direction, procures an axial outlet direction of the axial air stream.

In connection with the outlet direction and the acceleration of the axial air in conduit 5' this guarantees an axial air flow which is stable, uniform and of broad scope.

FIG. 3 shows an embodiment of the burner nozzle which differs from the embodiment shown in FIGS. 2*a* and 2*b* 2, essentially by the presence of an additional conduit 15', for powdered solid fuels, which is located between the flame stabilizer 3 and the conduit 4' of eddying primary air.

It is generally question of powdered coal which is transported in the burner by a vector gas, for example air. Due to the abrasive properties of such a solid fuel, the terminal zone of conduit 15' is only slightly conical in order to allow passage of the fuel which is as easy as possible.

FIG. 4 shows an embodiment comprising, in place of conduit 15' for a solid fuel, another conduit 19' for a gaseous fuel, whose terminal section may be conical, like conduit 4', and which may also comprise a device for eddying the gas issuing from this conduit. In that case too, the terminal section of conduit 19' is cylindrical in the zone of opening 19, in order to avoid a divergence of the gaseous fuel which issues therefrom.

FIG. 5 shows an embodiment which comprises both a supply conduit 15' for solid fuels and a conduit 19' for gaseous fuels.

Conduits 4' and 5' for the principal proportion of primary air in the form of eddying air and air having an axial direction are disposed outside these two fuel conduits in radial direction. The inner edge of the opening 15, by which a considerable part of the primary combustion air may penetrate in the burner in the form of vector gas for the solid fuel, is located at a distance D' from the axis of the burner, which is more than double the radius d of the opening 2 of the flame stabilizer, with the result that, in all cases, the existence is guaranteed at the centre of the flame of a sufficiently large dead zone which procures the advantageous properties of the present invention.

Thanks to the invention, a burner and a process for exploiting a burner equipping a rotary tube furnace have been created, which allow a reduced proportion of primary air and a broader range of adjustment of the burner, this leading to reduced energy consumption and a reduction of the formation of nitrogen oxides detrimental to the environment.

What is claimed is:

1. A burner for a rotary tube furnace comprising;

a flame stabilizer having a central opening, said flame stabilizer being being disposed adjacent a distal end of said burner, a plurality of concentrically arranged fuel supply conduits, said conduits having fuel outlet openings disposed outside said flame stabilizer, means forming a primary air supply conduit, said flame stabilizer being located in said primary air supply conduit.

means forming concentrically arranged combustion air channels, said combustion air channels having outlet orifices, said combustion air channels and said outlet orifices being arranged and constructed to transport axial air and eddying air, said outlet orifices being disposed radially outside said fuel outlet openings, wherein a radial distance of said combustion air outlet orifices with respect to a center point of said burner nozzle has a magnitude at least twice as great as a radius of said central opening of said flame stabilizer.

2. A burner for a rotary tube furnace according to claim 1, further comprising axially displaceable conical wall portions of said concentric air channels, and adjusting means for axially displacing said conical wall portions.

3. A burner for a rotary tube furnace according to claim 2, further comprising axially extendable partitions disposed in a zone between said conical wall portions, said partitions arranged and constructed to separate and direct flow of combustion air, whereby axial displacement of said axially displaceable conical wall portions changes the effective cross sectional area of said combustion air channels.

4. A burner for a rotary tube furnace according to claim 1, wherein said flame stabilizer comprises flame stabilizer openings disposed outside said central opening, said flame stabilizer openings being arranged and constructed to pass a small volume of primary combustion air.

5. A burner for a rotary tube furnace according to claim 1, wherein at least one of said concentrically arranged fuel supply conduits is disposed radially inside said combustion air channels and said outlet orifices, and is disposed outside said flame stabilizer.

6. A burner for a rotary tube furnace according to claim 1, wherein said outlet orifices are disposed at radial points furthest outside said fuel outlet openings, said burner having an outer edge projecting axially forward from said outlet orifices.

7. A burner for a rotary tube furnace according to claim 1, further comprising obturating means for adjustment of axial airflow through said combustion air channels.

8. A burner for a rotary tube furnace according to claim 1, wherein total available flow area of said combustion air channels is substantially smaller than area available in said primary air supply conduit, said burner including means for increasing flow velocity of combustion air discharged from said combustion air channels relative to that discharged from said primary air supply conduit.

9. A burner for a rotary tube furnace according to claim 1, wherein said flame stabilizer is offset axially to the rear with respect to said air outlet orifices and said fuel outlet openings.

10. A burner utilization process comprising the steps of:

discharging fuel through concentrically arranged a fuel conduit of annular cross section into a combustion zone, discharging a stream of primary air internally of said fuel and into said combustion znoe and through a central opening in a flame stabilizer located immediately upstream of said discharging of said fuel supplying at least a first stream and a second stream of air substantially coaxial with and radially external of said fuel conduit, supplying said first stream in an eddying flow pattern, supplying said second stream in a substantially axial direction radially external of said first stream, said second stream supplied in a substantially non-eddying flow pattern, and directing up to 20 percent of said primary air radially inwardly of said annular fuel supply to positively create an enlarged non-combination zone disposed adjacent a distal end of the burner and centrally aligned with respect to the burner.

11. A burner utilization process according to claim 10, wherein, an inside radius of a supply conduit for said primary air being no more than one-half of an inside radius of a supply conduit for said fuel.

12. A burner utilization process according to claim 10, wherein primary combustion air is restricted to between 2 percent and 10 percent of total combustion air.

13. A burner utilization process according to claim 10 including discharging fuel coaxially through the central opening of said flame stabilizer into said combustion zone.

* * * * *